United States Patent [19]

Klee

[11] Patent Number: 4,593,637

[45] Date of Patent: Jun. 10, 1986

[54] COMBINATION FRANGIBLE NOSE CAP EMI SHIELD

[75] Inventor: Harvey J. Klee, Lakeside, Calif.

[73] Assignee: The United States of America as represented by the Secretary of the Navy, Washington, D.C.

[21] Appl. No.: 616,866

[22] Filed: Jun. 4, 1984

[51] Int. Cl.[4] ..... F42B 19/46

[52] U.S. Cl. ..... 114/20 R; 102/293; 102/399

[58] Field of Search ..... 102/293, 399, 200, 202.1, 102/202.2, 211, 214; 114/20 R, 22

[56] References Cited

U.S. PATENT DOCUMENTS

| | | | |
|---|---|---|---|
| 2,889,772 | 6/1959 | Howard | 102/200 |
| 2,889,796 | 6/1959 | Williams et al. | 114/20 |
| 2,987,699 | 6/1961 | Miller | 114/21 R |
| 3,007,160 | 10/1961 | Halpern | 343/18 R |
| 3,110,262 | 11/1963 | West | 102/399 |
| 3,279,405 | 10/1966 | Billmeyer | 114/20 |
| 3,477,376 | 11/1969 | Nelson et al. | 102/399 |
| 3,613,617 | 10/1971 | Hamilton | 114/20 R |
| 3,636,877 | 1/1972 | Eaton | 102/49.5 |
| 3,674,227 | 7/1972 | Jacobson et al. | 102/293 |
| 3,971,024 | 7/1976 | Clark, Jr. et al. | 102/211 |
| 4,164,727 | 8/1979 | Morris | 367/1 |
| 4,192,246 | 3/1980 | Hodges et al. | 114/23 |
| 4,230,059 | 10/1980 | Kalaf et al. | 114/22 |

*Primary Examiner*—Charles T. Jordan

*Attorney, Agent, or Firm*—Robert F. Beers; Ervin F. Johnston; John Stan

[57] ABSTRACT

An improved frangible nose cap is presented which in addition to providing mechanical protection to the torpedo nose also provides electromagnetic interference (EMI) protection to the torpedo electronics systems. The improved nose cap is made up of a frangible material which may be impregnated, or coated, by methods well known in the prior art, with a conductive layer that can be electrically connected to the torpedo's electronic circuit ground for the EMI shielding.

5 Claims, 2 Drawing Figures

COMBINATION FRANGIBLE NOSE CAP EMI SHIELD

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Protective nose caps for missiles, such as torpedoes, which are dropped into the water are well known in the art. Such frangible nose caps provide mechanical protection to the torpedo and its systems to the jolt of the torpedo's entry into the water. The forces of water entry experienced by most torpedoes has made it mandatory that these torpedoes be fitted with frangible nose caps.

Frangible nose caps providing mechanical protection are usually designed in a manner that they break away upon the impact of the torpedo's entry into the water. Consequently, in modern torpedoes, where an acoustic window is built into the nose section of the torpedo, this delicate region is adequately protected from mechanical damage during entry into the water, and after break away of the frangible cap, is free to function in its acoustical mode without limitations of a mechanical nature remaining attached to the torpedo.

Present torpedo systems and designs require not only protection of the nose section from mechanical shock but also require protection from possible electromagnetic interference occurring to the torpedo electronic systems prior to the entry into the water. As a result, a need for the present invention has been established. The present invention addresses the purpose of simultaneously providing mechanical protection and electromagnetic interference (EMI) protection to the torpedo electronics and other systems during the period before the torpedo enters the water.

SUMMARY OF THE INVENTION

A nose cap for attachment on torpedoes is presented which is a combination frangible nose cap with electromagnetic interference shielding capabilities. The purpose of the invention is to combine the two functions, i.e., a frangible nose cap which protects the torpedo nose from mechanical damage upon entry into the water, and an electromagnetic interference (EMI) shield to protect the torpedo electronics while the torpedo is in air before its entry into the water. This is accomplished by adapting a metallic frangible nose cap or using a conventional polystyrene/foam nose cap with an electroplated conductive layer of material on the cap. Through appropriate techniques an electrical tie to the torpedo body or to the torpedo electronics ground is made to complete the EMI required shielding.

The EMI protection is accordingly provided to the torpedo electronics from the time the torpedo is launched until the time when the torpedo is away from the interference field which usually occurs upon the torpedo's entry into the water. At that time the frangible nature of the nose cap causes said cap to break away from the torpedo thereby allowing the torpedo sonar systems to operate in the water environment in an unhindered manner.

OBJECTS OF THE INVENTION

An object of this invention is to combine the functions of a frangible nose cap and an EMI shield to provide both electromagnetic interference protection and mechanical entry force protection to the torpedo upon entry into the water from an air launch delivery.

Another object of the invention is to accomplish EMI shielding prior to water entry for a torpedo by adapting an electroplated or metal frangible nose cap wherein the electrically conductive layer of material is connected to the torpedo body or the torpedo electronics ground circuit to establish EMI shielding of the torpedo system electronics.

Other objects, advantages and novel features of the invention will become apparent from the following detailed description of the invention when considered in conjunction with the accompanying drawings.

DESCRIPTION OF THE PREFERRED EMBODIMENT

Conventional torpedoes are designed with sonar windows in the torpedo nose section. These sonar windows are insulated from the outside environment by a rubber or neoprene material. When the torpedo is launched in the air environment the semifragile sonar window in the nose section is subject to strong mechanical forces as the torpedo enters the water. To protect against damage from such entry shock conventional torpedoes have been fitted with frangible nose caps. Such nose caps are constructed of a material which breaks away upon impact thus absorbing the forces of impact and thereby protecting the nose section during water entry. Frangible nose caps are designed to completely break away from the torpedo body before the time the torpedo goes into operation in the water environment.

Sonar array electronic systems in modern torpedoes have become extremely sophisticated. As such they are often subject to outside electromagnetic interference. As a result, it has become necessary to establish some form of electromagnetic interference shielding in order to protect electronics from being upset by spurious electromagnetic fields occurring while the torpedo is exposed to such. This occurs in the air environment during the launch phase period. Once the torpedo has entered the water electromagnetic interference fields are considerably reduced and no further need of a EMI shield is needed.

Figure 1A:
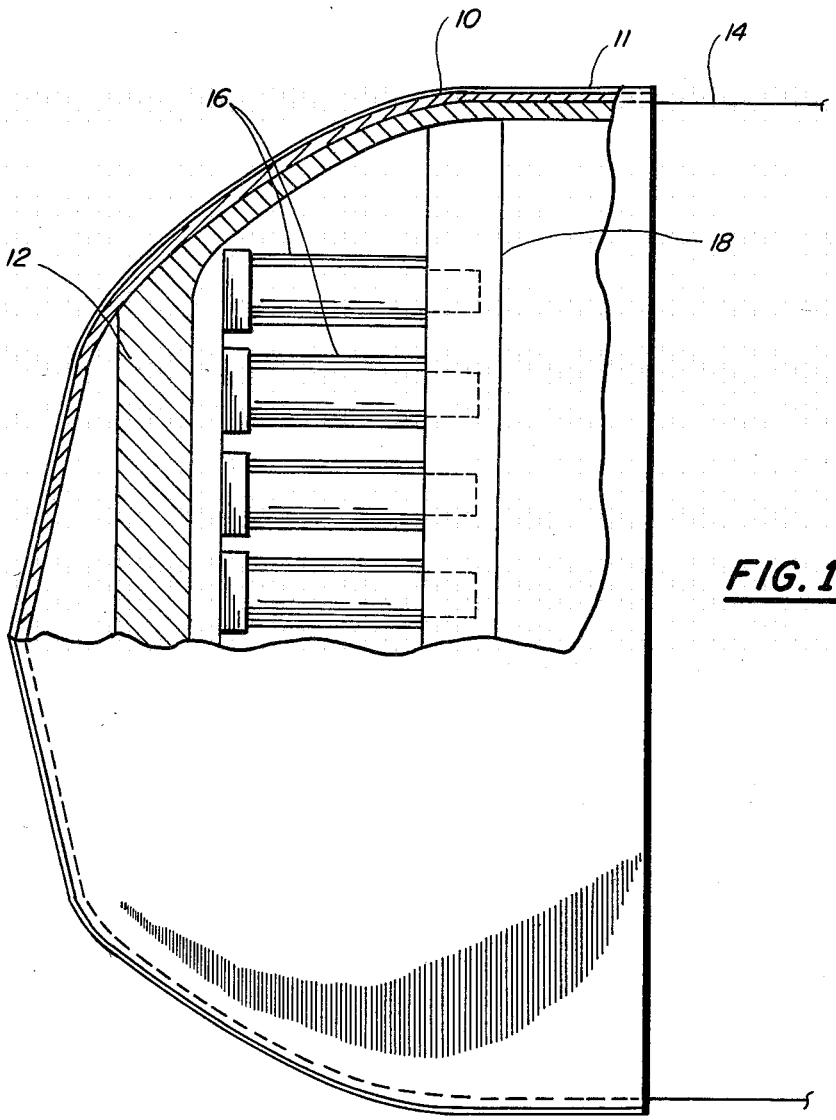
FIGS. 1A and 1B show cutaway views of an EMI shield modified frangible nose cap attached to the nose of a torpedo.

FIG. 1A shows the nose portion of a torpedo. Shown is a torpedo body 14, a torpedo acoustic window 12 at the nose of the torpedo, transducer elements 16, a strong back mounting plate 18 for the transducer elements, and a frangible nose cap 10. It is the sonar window 12, often made of rubber or neoprene material, which requires protection from mechanical shock and EMI shielding. The electronic system for the torpedo sonar and guidance is not shown but is contained within the body of the torpedo 14.

To establish EMI shielding, the frangible nose cap 10 can be electroplated if the material making up this nose cap is generally nonconducting. A conventional polystyrene/foam nose cap can be modified by electroplating a conductive layer of material on the cap. An alternative to electroplating a nonconducting frangible nose cap would be to construct the nose cap with impregnated conducting materials. A further alternative is to construct the frangible nose cap from a metallic material which is conducting and which fractures and breaks away upon impact with the water surface. Other similar means for combining EMI shield capability with a mechanical protective frangible nose cap are clearly recognizable and considered within the scope of the present invention.

Figure 1B:
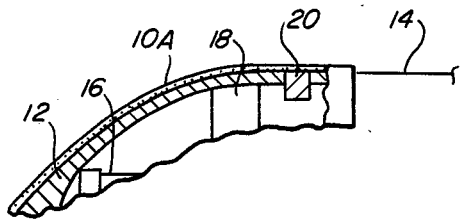

To effect proper performance of the EMI shield, it is paramount to insure that the electrically conducting material of the nose cap 10 is properly connected to the torpedo conductive body or to the torpedo electrical ground system. This electrical contact can be accomplished by a tight fit of the frangible nose cap 10 to the body of the torpedo 14 wherein the conductive material of the nose cap is in direct contact with a portion of metal on the body 14 of the torpedo. Where the design of the torpedo is such that direct electrical contact cannot be made with the torpedo electrical ground system by a press fit or slip fit of the cap 10 upon the torpedo body 14, such connection can be accomplished by creating a direct contact between the nose cap 10 and an electrode 20 constructed and inserted through the body 14 of the torpedo, as shown in FIG. 1B. Other methods of making this electrical contact are clearly recognizable and considered within the scope of this invention.

Obviously many modifications and variations of the present invention are possible in the light of the above teachings. It is therefore to be understood that within the scope of the appended claims the invention may be practiced otherwise than as specifically described.

What is claimed is:

1. An improved frangible nose cap for a torpedo containing grounded electronics within its body which further comprises:

means for electrically shielding the electronics contained within the torpedo body from electromagnetic interference, said means made a part of the frangible nose cap; and means for electrically connecting the shielding means to the body of the torpedo and to the electronics system's ground.

2. An improved frangible nose cap according to claim 1 wherein the means for shielding further comprises:

a conductive material deposited on the surface of said frangible nose cap.

3. An improved frangible nose cap according to claim 1 wherein the means for shielding further comprises:

a conducting material impregnated into the material of the frangible nose cap.

4. An improved frangible nose cap according to claim 1 wherein the means for shielding further comprises:

an electrically conducting metallic material for the frangible nose cap.

5. An improved frangible nose cap for a torpedo which contains grounded electronic circuitry within its body comprising:

means for electrically shielding the electronics contained within the torpedo body, the means comprising a part of the frangible nose cap; and means for electrically connecting the shielding means to the ground of the electronics system in the body of the torpedo.

* * * * *